US006527056B2

(12) United States Patent
Newman

(10) Patent No.: US 6,527,056 B2
(45) Date of Patent: Mar. 4, 2003

(54) VARIABLE OD COILED TUBING STRINGS

(75) Inventor: Kenneth R. Newman, Willis, TX (US)

(73) Assignee: CTES, L.C., Conroe, TX (US)

( * ) Notice: Subject to any disclaimer, the term of this patent is extended or adjusted under 35 U.S.C. 154(b) by 93 days.

(21) Appl. No.: 09/824,451

(22) Filed: Apr. 2, 2001

(65) Prior Publication Data

US 2002/0170716 A1 Nov. 21, 2002

(51) Int. Cl.[7] ..... E21B 17/20; E21B 19/22
(52) U.S. Cl. ..... 166/384; 166/308; 166/385
(58) Field of Search ..... 166/384, 385, 166/381, 308

(56) References Cited

U.S. PATENT DOCUMENTS

| | | | | |
|---|---|---|---|---|
| 456,883 | A | 7/1891 | Brightman | |
| 927,716 | A | 7/1909 | Davis | |
| 1,229,981 | A | 6/1917 | Lehmann | |
| 3,285,047 | A | 11/1966 | Crawford | |
| 3,838,591 | A | 10/1974 | Ross | 72/318 |
| 4,194,541 | A | 3/1980 | Ditges | 140/147 |
| 4,629,218 | A * | 12/1986 | Dubois | 285/148.22 |
| 5,042,280 | A | 8/1991 | Anagnostopoulos | 72/70 |
| 5,161,399 | A | 11/1992 | Piguet et al. | 72/79 |
| 5,503,370 | A | 4/1996 | Newman et al. | 254/134.3 FT |
| 5,590,915 | A * | 1/1997 | Recalde | 285/119 |
| 5,599,004 | A | 2/1997 | Newman et al. | 254/134.3 FT |
| 5,640,879 | A | 6/1997 | Damsohn et al. | 72/479 |
| 6,230,955 | B1 * | 5/2001 | Parks | 226/190 |
| 6,367,557 | B1 * | 4/2002 | Rosine et al. | 166/384 |

OTHER PUBLICATIONS

Development of a Coiled Tubing Cable Installation System, Newman et al, SPE, pp. 389–395, Oct. 1995.

CTD Poised to Make An Impact On Segments of Drilling Market, Newman, The American Oil & Gas Reporter, pp. 104, 106–108, Apr. 1996.

Benefits Fuel CT Growth, Kunkel, Hart's Petroleum Engineer Int'l, pp. 36, 37, 39–41, Jul. 1997.

Development and Use of An Analytical Method to Predict Coiled Tubing Diameter Growth, Brown et al, SPE 38409, Apr., 1997.

Defining Coiled Tubing Limits—A New Approach, Newman et al, OTC 8221, May 1996.

The Benefits of Real–Time Coiled Tubing Diameter Measurements, Quigley et al, SPE 46040, Apr. 1998.

Coiled Tubing Services, Nowsco, 1996.

The Coiled Tubing Boom, Moore, Petroleum Engineer Int'l, pp. 6–18, 20, Apr. 1991.

Sandvik Seamless Coiled Tubing, Sandvik Steel, Aug. 1995.

Bowen Coiled Tubing Systems, Bowen Tools, Inc., 1995.

Recompletions Using Large–Diameter Coiled Tubing: Prudhoe Bay Case History and Discussion, Blount et al, SPE 22821, Oct. 1991.

Design and Installation of a 20,500 foot Coiled Tubing Velocity String in the Gomez Field, Pecos, County, Texas, Adams et al, SPE 24792, Oct. 1992.

Reeled Systems Technology, SIEP 96–5285, Transforming coiled tubing into a complete E&P System, Nov. 1996.

* cited by examiner

*Primary Examiner*—Hoang Dang
(74) *Attorney, Agent, or Firm*—Guy McClung

(57) ABSTRACT

Coiled tubing or a portion thereof having a first part spaced-apart from a second part, the coiled tubing having a first outer diamter at the first part and a second outer diameter at the second part, the first outer diameter different from the second outer diameter, and outer diameter of the coiled tubing continuously diminishing or increasing from the first part to the second part, in one particular aspect thus varying over its entire length; and methods for using and methods and apparatuses for making such coiled tubing.

12 Claims, 4 Drawing Sheets

Profile – VODCT String Profile for a 30,000 ft Well

Strip Assembly Process

Tube Milling Process

Profile – VODCT String Profile for a 30,000 ft Well

VARIABLE OD COILED TUBING STRINGS

BACKGROUND OF THE INVENTION

1. Field Of The Invention

2. Description of Related Art

Coiled tubing ("CT") is typically relatively long continuous lengths of pipe, known as strings, which can be run in and out of a bore, pipeline, tubular string, borehole, or wellbore. The CT is usually made of steel or steel alloy, though it may be made of plastic, composites, titanium or other materials. The CT is typically stored on a reel.

CT strings typically have a constant outside diameter (OD). Its OD designates the CT size. Some typical CT sizes are 1.0", 1.25", 1.5", 1.75", 2.0", 2⅜", 2⅝", 2⅞" and 3.5". The wall thickness of the string may be constant, or may vary along the length of the string. Strings with varying wall thickness along the length of the string are known as "tapered" strings. U.S. Pat. No. 4,629,218 describes tapered strings. U.S. Pat. Nos. 4,863,091 and 5,191,911 describes manufacturing processes used for some conventional steel CT strings.

Some prior art stepped outer diameter ("OD") CT strings are made by connecting sections of CT with different outer diameters. A section of pipe with a machined OD varying from one size to the next is used in making the transition connection between one size and the next. For example, a stepped OD string may be made by connecting 5,000 ft. of 1.5" CT to 5,000 ft. of 1.75" CT. Another 5,000 ft. of 2.0" CT is connected to the 1.75" forming a 15,000 ft. string made of three sizes of CT. Use of some of these prior art stepped OD strings has been limited due primarily to concerns about the bending fatigue life of the string at connections.

Certain prior art manufacturing processes for steel CT include three steps or processes. In the first process, rolls of sheet steel known as master coils, typically 4 ft. to 6 ft. wide and 1,000 to 3,500 ft. long, are slit and into strips which are rolled into slit coils (e.g. like the coils 100 in FIG. 1). The strips in these slit coils are the length of the original master coil and are the width necessary to make the particular CT size being manufactured. The thickness of these strips may be constant or may vary gradually along the strip length to form a continuous taper as is described in U.S. Pat. No. 4,629,218.

In the second process, shown in FIG. 1, strips from the slit coils 100 are welded together at the welder 101, typically using biased welds described in U.S. Pat. Nos. 4,863,091 and 5,191,911. Once the weld is completed and inspected, the strip is spooled onto a large strip reel. Successive strips may have the same thickness as the previous strip, or may have a different thickness. If the strip thickness differs, the final CT will be a tapered string. As multiple strips are welded together, one long continuous strip is made on the strip reel to the desired length of the CT string, typically between 7,000 and 25,000 ft. long.

In the third process, shown in FIG. 2, the strip 103 from the large strip reel 102 passes through a series of sub-processes which manufacture or mill the strip into CT. In the first sub-process 104 the strip 103 passes through forming rollers that form the strip into a tube shape 105. These forming rollers are powered so that they pull the strip from the large strip reel 103 and move it through the milling process. In the next sub-process 106 the edges of the tube are welded together to form a longitudinal seam weld, typically using an electric resistance weld ("ERW") though other weld types may be used. When an ERW process is used an impeder is often placed inside the tube at the point where the weld is being created. As part of this welding process 106 a cutter cuts away the external weld flash. There may also abe an internal cutter that cuts away the internal weld flash. In the next sub-process 108 the weld seam of the welded tube 107 is heated to a temperature that normalizes the grain structure of the material. As part of the seam normalizing process 108 the seam is cooled by passing for a period of time through the air. In the next sub-process the tube 109 passes through sizing rollers that reduce the tube diameter slightly to its final size. These sizing rollers are also powered and help the forming rollers in moving the tube through the milling process. The sized tube 111 then passes through the next sub-process 112 in which it is heated to a stress relief temperature and then allowed to air cool. After air cooling the tube passes through a water bath for the final cooling 114. The completed tube 115 is then spooled onto a CT reel 116.

SUMMARY OF THE PRESENT INVENTION

In certain embodiments, the present invention provides coiled tubing strings in which the outer diameter varies continuously or nearly continuously over a portion of the string's length. Methods according to the present invention for making such strings are also disclosed. These continuously varied OD CT ("VODCT") strings can be designed for excellent performance in many situations. In certain aspects they reduce or eliminate bending fatigue problems associated with prior art stepped OD CT strings.

In certain embodiments VODCT strings according to the present invention provide additional strength where it is needed; modify the velocity and pressure profile in a CT string and/or in the annulus between the CT string and the bore; provide the larger diameter where needed while meeting weight and size restrictions; have varying wall thickness; and/or provide diameter profile needed when snubbing against high pressures.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

What follows are some of, but not all, the objects of this invention. In addition to the specific objects stated below for at least certain preferred embodiments of the invention, other objects and purposes will be readily apparent to one of skill in this art who has the benefit of this invention's teachings and disclosures. It is, therefore, an object of at least certain preferred embodiments of the present invention to provide:

- New, useful, unique, efficient, nonobvious coiled tubing strings or parts thereof with an outer diameter that varies continuously or nearly continuously over all or over a portion of the strings' length;
- Methods for making such CT strings;
- Such strings that can modify velocity and pressure profiles in a CT string; and
- Such strings that provide larger outer diameter in a desired location and/or provide a diameter profile needed when snubbing against high pressure.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

DESCRIPTION OF EMBODIMENTS PREFERRED AT THE TIME OF FILING FOR THIS PATENT

Improved Forces Capabilities

Figure 1:
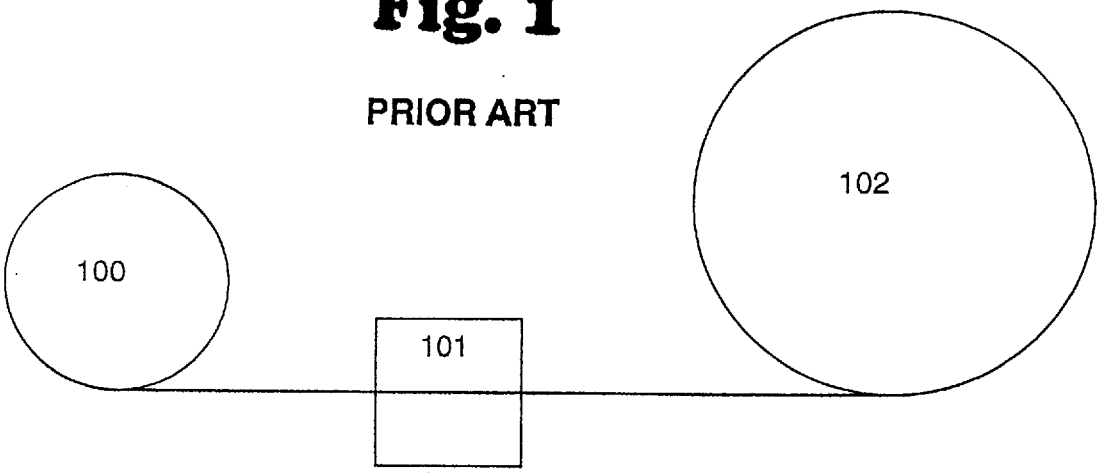
Fig. 1 PRIOR ART
FIG. 1 is a schematic view of a prior art slip assembly method.

In certain aspects, when CT is run into a well, the point of maximum tensile axial force in the CT is typically at the surface, just below the stripper or seal which seals around the CT, separating the pressure in the well from the atmosphere. This axial force is caused by the hanging weight of the CT string in the well. Additional axial force may be applied to the CT string when it is being pulled from the well due to friction between the CT string and the wellbore. This friction is greater in deviated and curved wellbores. Computer models, called tubing forces models, are often used to calculate the forces in the CT string.

The axial force (Fa) in the CT causes an axial stress in the CT material. The axial stress ($\sigma_a$) is defined as the axial force divided by the cross-sectional area (A) of the CT material.

There are other stresses in the CT material due to the pressure in the well and in the CT. When the combined stresses become too large, the CT material will yield and eventually fail. Stress limits are set for various CT materials to prevent CT failures.

In some cases the CT operational envelope in wells is limited because the axial stress limit is reached. The axial stress can be reduced if the area (A) of the CT material is increased. The increasing wall thickness of tapered strings increases the area (A) and thus expands the operational envelope of CT. However, the practical amount that the wall thickness can be increased is limited due to the reduction in the inside diameter ("ID") of the CT. The increase in the OD with VODCT increases the area (A) of the CT and thus reduces the axial stress. VODCT strings according to the present invention can thus, in certain aspects, increase the operating envelope for CT and, in some aspects, increase it significantly.

In one example, when running CT into a 30,000 ft. deep empty vertical well it is assumed that the yield stress ($\sigma_y$) of the CT material is 100,000 psi and the density ($\rho$) of the CT material is 0.283 lb/in$^3$. For safety purposes the maximum axial stress will be limited to 60% of the yield stress. If a simple straight prior art CT string with constant OD and constant wall thickness is used, the cross-sectional area (A) remains constant. In this case the maximum depth the CT can be run to is:

$$D_{\max} = \frac{0.6\sigma_y}{12\rho} = 17,668 \text{ ft.}$$

A straight, simple CT string cannot reach the bottom of this example well. When using a prior art tapered CT string with a constant OD of 1.5", five (5) wall thicknesses are used beginning with 0.109" for the bottom section of the string, then 0.118", 0.125", 0.134" and 0.156" sections. The 0.109" section can be 17,668 ft. long before reaching the 60% of the yield stress limit according to the equation above. The 0.118" section must bear the load of the 0.109" section. The 0.118" section can be 1,241 ft. long before the 60% limit is reached. The maximum depth that this type of tapered string can be run to is 23,135 ft., which is still not sufficient to reach the bottom of this well.

Using a VODCT string according to the present invention the string is designed so that the axial stress does not exceed 60% of the yield stress. For the first 17,668 ft., the string will be straight 1.5" OD with a 0.109" wall as discussed above. "ODs" is defined as the OD of the straight section, 1.5" in this example. The OD to thickness ratio ($\xi$) for this straight section is 13.76. From 17,668 ft. to 30,000 ft., the OD of the string increases gradually. The wall thickness also increases gradually, so that the OD to thickness ratio ($\xi$) remains constant. For the axial stress to remain constant at 60% of the yield stress, the OD between 17,668 ft and 30,000 ft. is:

$$OD = \sqrt{\frac{\pi}{4} e^{a(x+x_a)}}$$

$$a = \frac{1}{D_{\max}}$$

$$x_0 = D_{\max}\left[\log_n\left(\frac{4}{\pi} OD_s^2\right) - 1\right] = 927.5 \text{ ft.}$$

x=the length along the string between 17,668 and 30,000 ft.

The wall thickness at any point in the string can be calculated by:

$$t = \frac{OD}{\xi} = \frac{OD}{13.76}$$

Figure 7:
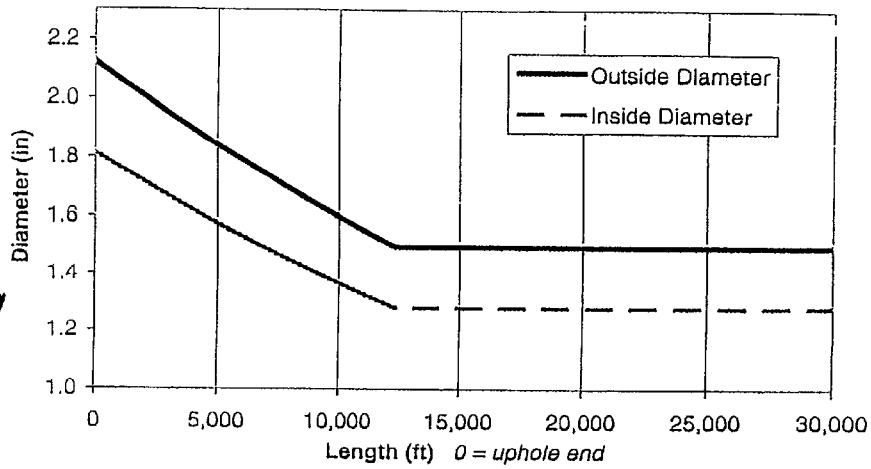
FIG. 7 is a graphical representation of string according to the present invention.

In this example, the OD of the CT string at 30,000 ft. is 2.126" and the wall thickness is 0.155". FIG. 7 shows the profile of this exemplary VODCT string according to the present invention that will reach 30,000 ft. without exceeding 60% of the yield stress.

A similar type of VODCT string according to the present invention is for very long extended reach wells where the friction forces become so large that a conventional CT string may not be able to be pushed into the well (due to insufficient bending stiffness to avoid helical buckling) or pulled form the well (due to excessive axial stress) within the safe operating limits of the CT material.

Reduced Snubbing Force

When the end of a CT string is first inserted into the well it must be pushed or "snubbed" into the well against a "snubbing force". In certain embodiments using a CT string according to the present invention results in reduced snubbing forces. The wellhead pressure multiplied by the cross-sectional area of the CT that is in the stripper is an upward force (snubbing force), which is trying to push the CT out of the well. As the CT is run deeper into the well, the hanging weight of the string becomes sufficient to overcome the snubbing force, and no more snubbing is required.

The equipment used to run CT in and out of wells is typically designed primarily for applying an upward tensile force on the CT, and is limited in the amount of downward compressive snubbing force it can apply. Because of this limitation, the OD of the CT that can be run in high-pressure wells is limited. The smaller CT ODs have smaller cross-sectional areas and thus require smaller snubbing forces when first inserted into the well. However, the smaller CT can limit the work that can be performed in a well. In many applications fluids are pumped through the CT to clean sand or cuttings out of the well. The small CT ID can restrict the flow rate of the pumped fluid.

A continuously varied outer diameter CT string according to the present invention can be used to improve this situation. The first portion of the string has a small OD to meet the snubbing force limit. After some of the CT is hanging in the well, its hanging weight reduces the snubbing force required and the OD of the string increases.

In one example a CT string is to be run into a 15,000 ft. vertical well with a wellhead pressure of 10,000 psi. Both the well and the CT are filled with water with a density ($\rho_w$) of 8.34 lb/gal. The CT injector is limited to a snubbing force of 15,000 lbs and is limited in CT OD to 1.75". The pump used for pumping the water through the CT is limited to a pump pressure of 15,000 psi. For simplicity, the stripper friction or pack-off will be ignored. The CT material yield stress is 100,000 psi. The combined Von Mises stress will be limited to 80% of the yield stress.

Figure 8:
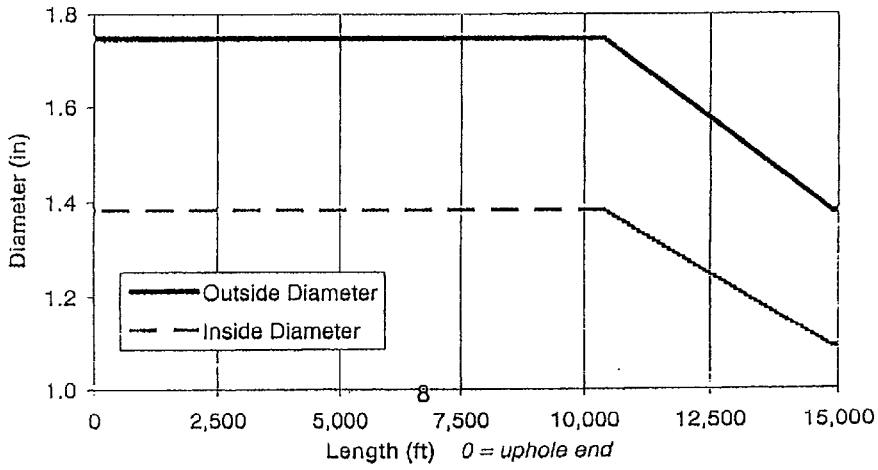
FIG. 8 is a graphical representation of a string according to the present invention.

The maximum OD CT that can be snubbed against this wellhead pressure is 1.382". FIG. 8 shows the profile for a VODCT string according to the present invention that can be run into this well while pumping at 15,000 psi. In the first 4,500 ft., the OD tapers from 1.382" to 1.75". The diameter-to-thickness ratio is kept constant at 9.6. In the strings shown in FIGS. 7 and 8, the wall thickness varies proportionally to the outer diameter. It is within the scope of this invention to have a string or portion thereof with a wall thickness that is constant or that varies porportionally to the outer diameter.

If a straight 15,000 ft. CT string with an OD of 1.382" and a wall thickness of 0.144" is used on this well, the maximum flowrate of water that can be pumped through the string with 15,000 psi pump pressure is about 50 gal/min. If the VODCT string according to the present invention discussed above is used, the maximum flowrate is about 90 gal/min. Thus, using the VODCT string according to the present invention increases the possible flowrate by 80%.

Production or Velocity String for Gas Wells

Often gas wells produce not only natural gas, but also some water and/or liquid condensate. The tubing in a gas well is designed so that these produced liquids are carried to the surface and produced with the produced gas. If the liquids are not produced they will collect or "load up" in the well until the production of the well is impaired or stopped. To ensure that the liquids are produced, the tubing is designed so that the velocity of the gas is high enough to carry the produced liquids. Since the highest pressure in the well will be at the bottom, the tubing is selected to provide this high gas velocity at the bottom. As the gas moves up the well, the pressure decreases and the volume of the gas increases. If the tubing has a constant ID, the velocity of the gas must increase to handle the increased volume. By the time the gas approaches the surface, the velocity may become very high, causing the upper portion of the tubing to choke the gas flow.

In methods and systems according to the present invention to deal with these problems, a VODCT string according to the present invention is used as the tubing string. Thus VODCT string is designed so that inside area of the string increases as the pressure decreases, so that the velocity is constant or nearly constant. This VODCT string has a larger diameter at the surface that tapers to a smaller diameter at the bottom.

As gas wells age their bottom hole pressure decreases, causing the gas velocity to decrease. If the gas velocity becomes too low, the wells load up with liquid. Often hanging a CT string in the well as a barrier to reduce the flow area rectifies this problem. Such a string is called a velocity string. The gas and liquids are usually produced up the annulus between the velocity string and the tubing in the well. To prevent the gas velocity from becoming too high near the surface, it may be desirable for the annulus area to be smaller at the bottom and larger at the top. Prior art stepped CT velocity strings have been used for this purpose, with the larger diameter section of CT at the bottom of the well and the smaller diameter section of the CT at the top of the well. A VODCT string according to the present invention maintains a more constant velocity in the well. In one aspect such a VODCT string according to the present invention has a smaller diameter at the surface that tapers to a larger diameter at the bottom.

Fracturing String

CT is used extensively in prior art methods for fracturing treatments of wells. During a fracturing treatment a fluid carrying a sand-like proppant is pumped through the CT and into the formation. The velocity of the proppant as it goes around bends in the CT often erodes the CT material. Thus it is desirable to use large diameter CT where there are bends in the CT, e.g. but not limited to, at the surface. The size of CT that can be used is often limited by the size and weight of the reel on which the CT is transported. If the reel is too large it may exceed road or crane weight limits, making it impractical or impossible to use.

A VODCT string according to the present invention designed with a larger diameter at surface, tapering down to a smaller diameter in the well (e.g. in part or in substantially all of a well) reduces the velocity of the fracturing fluid and proppant as it passes through the bends in the CT (e.g. but not limited to bends at the surface), reducing or eliminating the undesirable erosion. The portion of the VODCT string that is in the well does not have any significant bends and thus can handle a larger velocity without erosion. Most of the string (e.g. more than 50%), in certain embodiments, may be of the smaller diameter, allowing the entire string to meet weight and size limitations.

Methods of Manufacture

In one method, according to the present invention, a strip for producing CT according to the present invention (like the strip 103, FIG. 1) is cut with varying width so that when the strip is formed into a tube it has the desired variable OD. This sub-process of cutting the strip to a variable width is performed as part of the original strip slitting process, or as a separate process, or as an additional sub-process in the strip assembly process (like that of FIG. 1), or in a tube milling process (like that of FIG. 2) before a forming sub-process (like that of item 104, FIG. 2) or in the middle of the forming sub-process.

Figure 2:
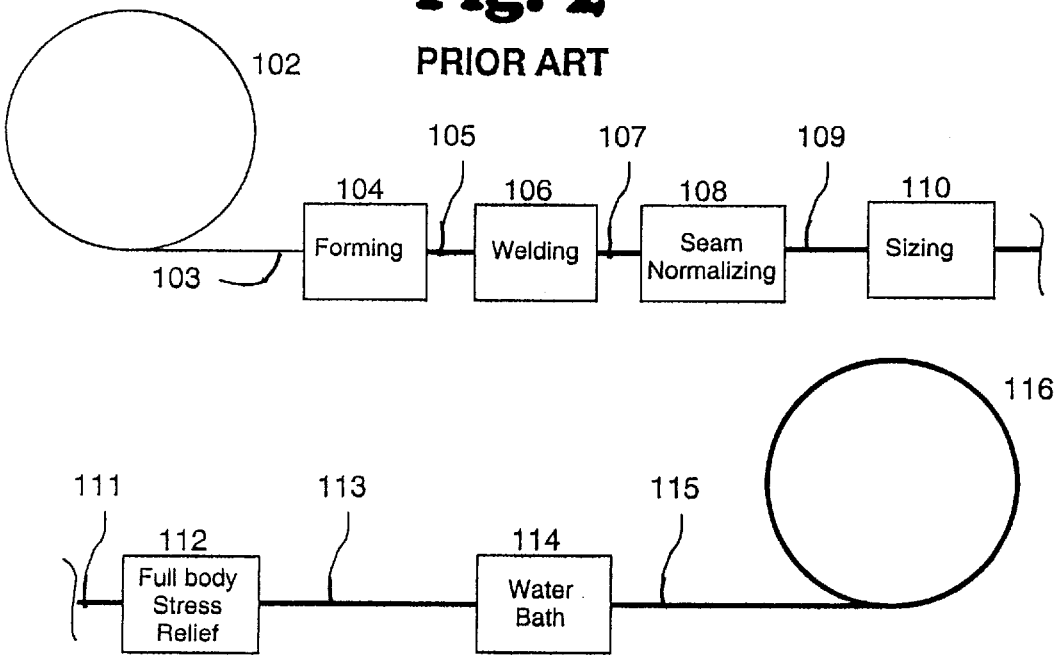
Fig. 2 PRIOR ART
FIG. 2 is a schematic view of a prior art tube miling method.
Figure 9:
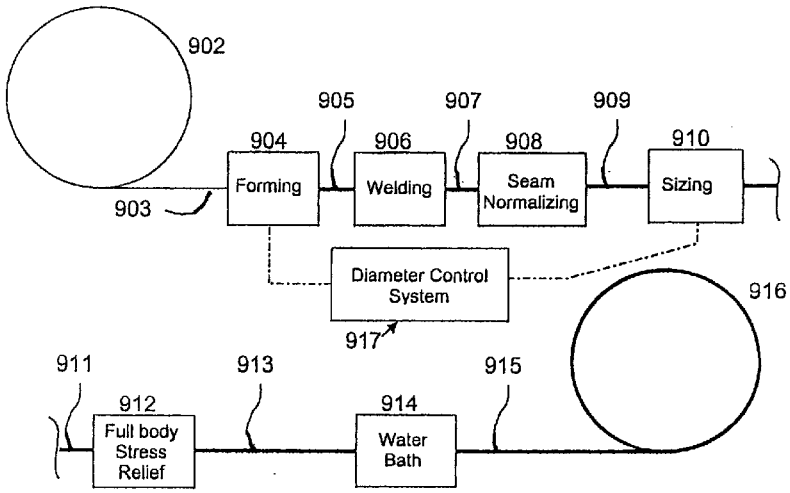
FIG. 9 is a schematic view of a tube milling method according to the present invention.

The varying strip width and corresponding varying OD requires modifications to several of the sub-processes in the prior art tube milling process of FIG. 2. As shown in FIG. 9, in a method according to the present invention, a strip 903 from a reel 902 enters a forming sub-process 904 capable of forming a tube 905 of varying OD. The first few rollers in the forming process are fixed forming rollers like those used for a constant OD CT string of the largest OD that will exist in the VODCT string being built. These rollers are fixed in that their shaping profile does not change throughout the length of the CT string. These fixed rollers shape the strip into approximately a U-shaped cross-section with a fixed curvature, no matter the width of the strip. Other items, apparatuses, and steps in the method of FIG. 9 correspond to similar items, etc. in the method of FIG. 2; e.g., the numerals 108 and 908 idnicate the same seam normalizing step.

Figure 3:
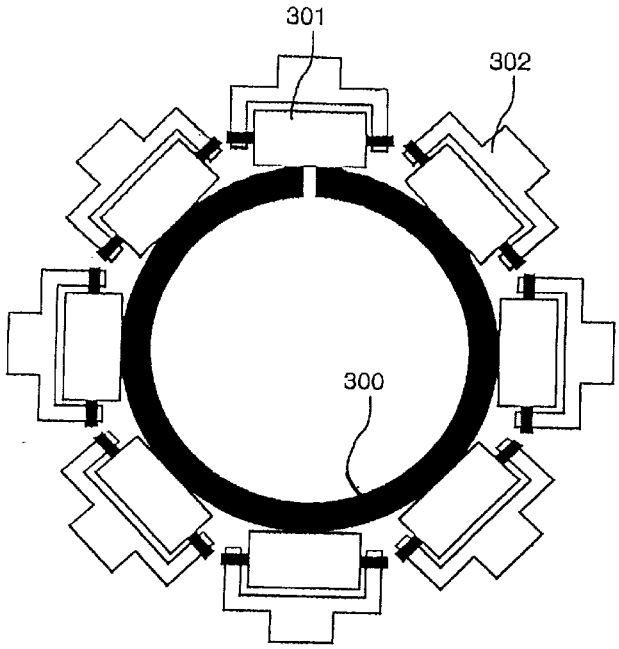
FIG. 3 is a top view of a roller mechanism according to the present invention.

A next set of rollers are variable forming rollers as shown in FIG. 3. The strip 300 in FIG. 3 has almost completed the forming process and is nearly a tube. Several rollers 301 surround the strip/tube 300. The surface of these rollers may be either straight as shown, or concave to fit the maximum OD of the string. These rollers 301 are held in yokes 302 that can be moved radially to adjust for varying ODs. The yokes 302 are connected to linear motion mechanisms such as pistons that move the yokes radially as required to vary the diameter of the string. The mechanism for moving the yokes is not shown. The rollers may be or may not powered. The rollers may all be in one plane perpendicular to the axis of the tube, or the rollers may be placed at various positions axially along the tube.

Figure 4A:
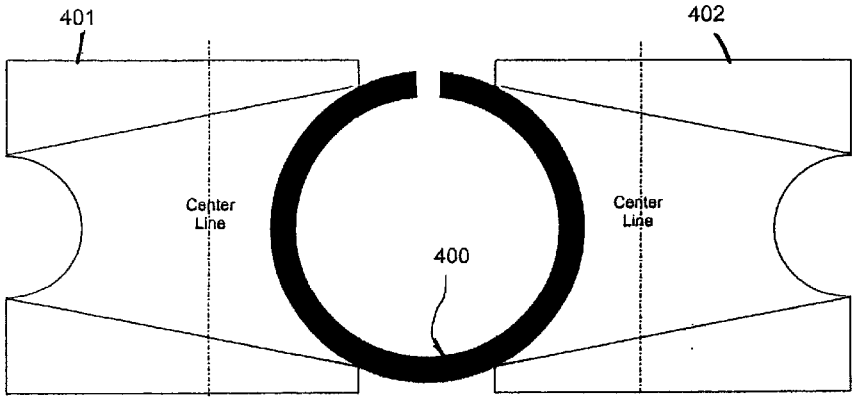
FIGS. 4A and 4B are top views of die mechanisms useful in methods according to the present invention.

Variable dies, shown in FIG. 4A may be used in the forming process. The strip/tube 400 (like the strip/tube 300, FIG. 3) passes between two forming dies 401 and 402. The forming dies are rotated about their centerlines to form the required diameter for that portion of the tube. A method according to the present invention may use the dies as in FIG. 4A or 4B and/or the rollers as in FIG. 3 to form the string.

Figure 4B:
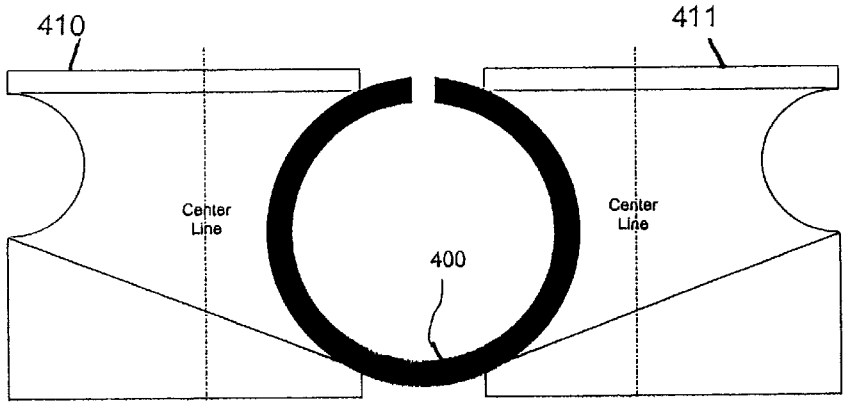

FIG. 4B shows the strip/tube 400 passing between two forming dies 410, 411. These dies are rotated as are the dies 401, 402 (FIG. 4A).

Either the variable OD forming rollers and the variable dies are designed so that the centerline of the tube stays in the same place for various tube diameters, or they are designed so that the edges of the strip which will be welded remain at the same place for various diameters.

In the system of FIG. 4A, the centerline of the strip/tube is maintained in the same position. In the system of FIG. 4B the point of welding (the top where the strip edges meet) is maintained at the same position. With the system of FIG. 3, the location of the centerline of the strip/tube depends on the roller location as adjusted and set by the interconnected linear motion mechanisms of the yokes. In one aspect as the string gets larger the top roller is maintained in a fixed position and the bottom roller is moved down to maintain the weld location in the same position.

A control system 917 or a plurality of control systems are used to control the variable OD forming rollers and/or the variable OD dies. The control system(s) 917 measure how far apart the edges of the strip are, and adjust the rollers and/or dies to maintain the desired spacing. These control system(s) also ensure the correct amount of forging force is applied to the edges of the CT in the welding sub-process 906.

In the welding sub-process 906 for the longitudinal seam the size of the impeder is varied by having a tapered impeder that is moved axially during the welding process so that correct diameter is maintained. The largest portion of the impeder must still fit through the smallest portion of the VODCT.

The sizing sub-process 910 works for the largest diameter of the VODCT string. In some cases, such as FIG. 8, a significant percentage of the string is at the maximum OD. With the rest of the VODCT string, maintaining the exact OD is not critical, so sizing is unnecessary. However, the sixing rollers also apply an axial force that helps move the CT through the mill. In the case of VODCT, a pulling device in the sizing sub-process 910 such as powered rollers much like the variable forming rollers, or some other pulling device, may be added to apply the required axial force. A completed tube 915 according to the present invention is spooled onto a reel 916.

In another method according to the present invention, a constant OD CT string is manufactured which is the maximum diameter of the desired VODCT string. Then, either as part of the same tube milling process or as a separate process, the portions of the string that are intended to be a smaller diameter are drawn or rolled down to the desired diameter. Many prior art patents disclose the general process of drawing flat stock, tubes, rods and the like through rotating dies, rolling mills, hot stretch millsand so forth. Typical of these prior art references are U.S. Pat. Nos. 3,783,663; 433,580; 860,879; 989,508; 1,178,812 and 1,200,304.

Figure 5:
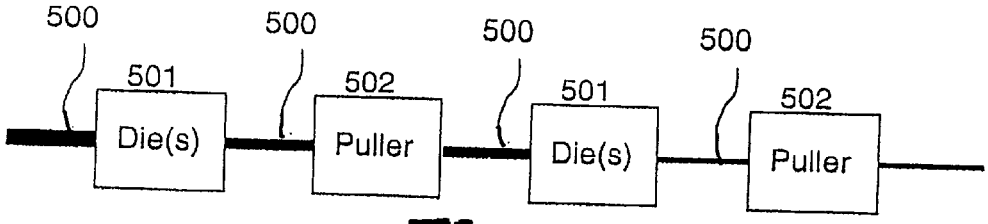
FIG. 5 is a schematic view of a drawing method according to the present invention.

FIG. 5 shows a drawing process according to the present invention that reduces the OD of a tube 500. A significant axial force is required to pull the tube 500 through the dies. Thus, the drawing process is made up of a series of dies 501 which reduce the OD, and pullers 502 which apply the required axial load. The number of dies and pullers needed depend upon the amount the OD needs to be reduced. This process is performed as a cold working process in which the tube is pulled through the dies cold, or it is a hot working process. In a hot working process the tube is heated before being pulled through the dies.

Figure 6A:
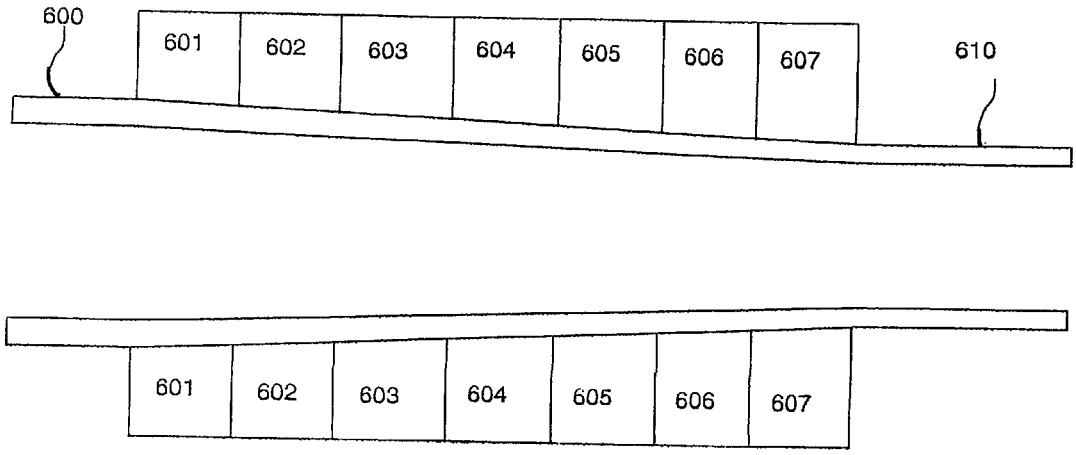
FIG. 6A is a side cross-section view of a die mechanism according to the present invention.
Figure 6B:
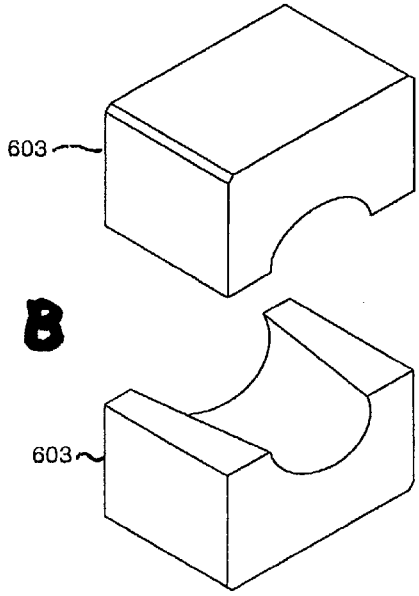
FIG. 6B is a perspective view of part of the mechanism of FIG. 6A.

Dies 501 may, according to the present invention, be variable OD dies as shown in FIG. 4A. This allows the same dies to be used for the entire operation. Alternatively, the dies 501 may, according to the present invention, be a series of fixed dies that are split longitudinally, so they may be removed when they are no longer needed. FIGS. 6A and 6B show such a series of die segments. The VODCT is being reduced from a large diameter 600 to a smaller diameter 610 by a series of fixed dies 601 through 607. For the OD of the VODCT to increase, die segments (607, then 606, etc.) are removed. This causes a fairly abrupt but small increase in diameter. Thus a VODCT string formed using a series of dies like this according to the present invention has a series of small steps in the OD which form a nearly continuous OD taper.

Pullers may be powered rollers capable of variable diameters, like those shown in FIG. 3. Alternatively, CT injectors capable The present invention, therefore, provides in certain, but not necessarily all embodiments, coiled tubing with a first end spaced-apart from a second end, the coiled tubing having a first outer diamter at the first end and a second outer diameter at the second end, the first outer diameter larger than the second outer diameter, and outer diameter of the coiled tubing continuously diminishing or increasng from the first end to the second end or coiled tubing having a portion thereof with such a continuously varying outer diameter.

The present invention, therefore, provides in certain, but not necessarily all embodiments, coiled tubing with a first end spaced-apart from a second end and an intermediate portion between the first end and the second end, the coiled tubing having a first outer diameter at the first end, a second outer diameter at the second end, and a third outer diameter at the intermediate portion, and outer diameter of the coiled tubing continuously varying from the first end to the intermediate portion and/or from the intermediate portion to the second end. Such coiled tubing may have: an outer diameter that continuously increases or decreases from the intermediate portion to the second end and/or from the first end to the intermediate portion; and/or a wall thickness that varies, e.g., but not limited to, varying proportionally to the outer diameter.

The present invention, therefore, provides in certain, but not necessarily all embodiments, a method for pulling a coiled tubing string from (or pushing it into) a wellbore (or form a pipeline) extending from earth surface down into the earth, the method including pulling the coiled tubing from the wellbore, the coiled tubing as any disclosed herein according to the present invention, e.g. but not limited to with a continuously diminishing outer diameter from the earth surface to its lower end; and/or wherein the coiled tubing has material with a yield stress and an axial force is imposed on the coiled tubing, the axial force causing an axial stress in the coiled tubing material, and wherein the axial stress is limited to 80%, 60% or 40% of the yield stress of the coiled tubing material by sizing the outer diameter of the coiled tubing.

The present invention, therefore, provides in certain, but not necessarily all embodiments, a method for snubbing coiled tubing into a wellbore extending from earth surface down into the earth, the method including introducing coiled tubing into the wellbore, the coiled tubing having an outer diameter of the coiled tubing continuously diminishing from a first end to a second end thereof and the method including introducing the second end first into the wellbore; and such a method wherein an intermediate point on the coiled tubing is between the first end and the second end and the weight of the coiled tubing between the intermediate point and the second end counters snubbing force required for insertion of the coiled tubing into the wellbore. Simliarly the present invention provides, in certain if not all embodiments, a method for pulling or pushing a coiled tubing string into or out of a pipeline or into or out of a wellbore extending from the earth surface down into the earth.

The present invention, therefore, provides in certain, but not necessarily all embodiments, a method for producing a fluid from a wellbore, the wellbore extending down from an earth surface into the earth, the fluid containing gas and liquid, the method including installing coiled tubing in the wellbore, the coiled tubing comprising the coiled tubing having a first outer diamter at the first end and a second outer diameter at the second end, the first outer diameter larger than the second outer diameter, and outer diameter of the coiled tubing continuously diminishing from the first end to the second end, and the second end below the first end in the wellbore.

The present invention, therefore, provides in certain, but not necessarily all embodiments, a method for producing a fluid from a wellbore, the wellbore extending down from an earth surface into the earth, the fluid containing gas and liquid, the method including installing coiled tubing in the wellbore, the coiled tubing comprising the coiled tubing having a first outer diamter at the first end and a second outer diameter at the second end, the first outer diameter larger than the second outer diameter, and outer diameter of the coiled tubing continuously increasing from the first end to the second end, and the second end below the first end in the wellbore.

The present invention, therefore, provides in certain, but not necessarily all embodiments, a method for introducing fracturing treatment material into an earth formation, the method including pumping a fluid with fracturing treatment material down into a tubular string extending down from an earth surface into an earth formation, the string having a first portion with a first diameter at the earth surface and a second portion with a second diameter at a portion of the string within the earth formation, the string having a continuously varying diameter from the first portion to the second portion, the first diameter smaller than the second diameter, and the velocity of the fluid with fracturing treatment material less whenit flows in first portion of the string than in the second portion of the string; such a method wherein the relative lower velocity of fluid in the first portion is effective so that erosion of the first portion of the string by the fluid with fracturing treatment material is less than that in the second portion of the string; and/or such a method wherein the second portion compirises more than 50% of the string; and such a method in which a realtively larger diameter string portion is provided for parts of the string that are bent, e.g., but not limited to, portions of tubing at the surface that have bends therein.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112. The inventors may rely on the Doctrine of Equivalents to determine and assess the scope of their invention and of the claims that follow as they may pertain to apparatus not materially departing from, but outside of, the literal scope of the invention as set forth in the following claims.

What is claimed is:

1. A method for pulling a coiled tubing string from a wellbore extending from earth surface down into the earth, the method comprising pulling the coiled tubing from the wellbore, the coiled tubing comprising the coiled tubing having a first outer diamter at the first end and a second outer diameter at the second end, the first outer diameter larger than the second outer diameter, and outer diameter of the coiled tubing continuously diminishing from the first end to the second end.

2. The method of claim 1 wherein the coiled tubing has material with a yield stress and an axial force is imposed on the coiled tubing, the axial force causing an axial stress in the coiled tubing material, and wherein the axial stress is limited to 80% or less of the yield stress of the coiled tubing material by sizing the outer diameter of the coiled tubing.

3. A method for snubbing coiled tubing into a wellbore extending from earth surface down into the earth, the method comprising introducing coiled tubing into the wellbore, the coiled tubing comprising the coiled tubing having a first outer diamter at the first end and a second outer diameter at the second end, the first outer diameter larger than the second outer diameter, and outer diameter of the coiled tubing continuously diminishing from the first end to the second end, and the method including introducing the second end first into the wellbore.

4. The method of claim 3 wherein an intermediate point on the coiled tubing is between the first end and the second end and the weight of the coiled tubing between the intermediate point and the second end counters snubbing force required for insertion of the coiled tubing into the wellbore.

5. A method for producing a fluid from a wellbore, the wellbore extending down from an earth surface into the earth, the fluid containing gas and liquid, the method comprising installing coiled tubing in the wellbore, the coiled tubing comprising the coiled tubing having a first outer diamter at the first end and a second outer diameter at the second end, the first outer diameter larger than the second outer diameter, and outer diameter of the coiled tubing continuously diminishing from the first end to the second end, and the second end below the first end in the wellbore.

6. A method for producing a fluid from a wellbore, the wellbore extending down from an earth surface into the earth, the fluid containing gas and liquid, the method comprising installing coiled tubing in the wellbore, the coiled tubing comprising the coiled tubing having a first outer diamter at the first end and a second outer diameter at the second end, the first outer diameter larger than the second outer diameter, and outer diameter of the coiled tubing continuously increasing from the first end to the second end, and the second end below the first end in the wellbore.

7. A method for introducing fracturing treatment material into an earth formation, the method comprising pumping a fluid with fracturing treatment material down into a tubular string extending down from an earth surface into an earth formation, the string having a first portion with a first outer diameter at the earth surface and a second portion with a second outer diameter at a portion of the string within the earth formation, the string having a continuously varying outer diameter from the first portion to the second portion, the first outer diameter larger than the second outer diameter, and reducing velocity of the fluid with fracturing treatment material by flowing it from the first portion of the string to the second portion of the string.

8. The method of claim 7 wherein the reduction in velocity is effective to reduce erosion of the string by the fluid with fracturing treatment material.

9. The method of claim 7 wherein the second portion compirises more than 50% of the string.

10. A method for pushing a coiled tubing string into a wellbore extending from earth surface down into the earth, the method comprising pushing the coiled tubing into the wellbore, the coiled tubing comprising the coiled tubing having a first outer diamter at the first end and a second outer diameter at the second end, the first outer diameter larger than the second outer diameter, and outer diameter of the coiled tubing continuously diminishing from the first end to the second end.

11. A method for pushing a coiled tubing string into a pipeline, the method comprising pushing the coiled tubing into the pipeline, the coiled tubing comprising the coiled tubing having a first outer diamter at the first end and a second outer diameter at the second end, the first outer diameter larger than the second outer diameter, and outer diameter of the coiled tubing continuously diminishing from the first end to the second end.

12. A method for pulling a coiled tubing string from a pipeline, the method comprising pulling the coiled tubing from the pipeline, the coiled tubing comprising the coiled tubing having a first outer diamter at the first end and a second outer diameter at the second end, the first outer diameter larger than the second outer diameter, and outer diameter of the coiled tubing continuously diminishing from the first end to the second end.

* * * * *